United States Patent [19]

Farnsworth

[11] Patent Number: 4,911,764

[45] Date of Patent: Mar. 27, 1990

[54] GALVANIZING FLUXES

[76] Inventor: Verdun H. Farnsworth, 106a Godden Crescent, Mission Bay, Auckland, New Zealand

[21] Appl. No.: 233,131

[22] Filed: Aug. 17, 1988

[30] Foreign Application Priority Data

Aug. 17, 1987 [NZ] New Zealand ..... 221470

[51] Int. Cl.[4] ..... B23K 35/34

[52] U.S. Cl. ..... 148/26; 148/24

[58] Field of Search ..... 148/24, 26; 75/57

[56] References Cited

U.S. PATENT DOCUMENTS 3,623,862 11/1971 Spengler ..... 75/57

3,752,882 8/1973 Muller ..... 148/26

FOREIGN PATENT DOCUMENTS 2240046 11/1973 Fed. Rep. of Germany .

*Primary Examiner*—Peter D. Rosenberg

*Attorney, Agent, or Firm*—Fleit, Jacobson, Cohn, Price, Holman & Stern

[57] ABSTRACT

A chloride based galvanizing flux containing at least zinc chloride, ammonium chloride and a rare earth chloride. The rare earth chloride comprises between substantially 500 parts per million and substantially 10% by weight of said flux.

9 Claims, No Drawings

GALVANIZING FLUXES

This invention relates to a galvanising flux for use in the galvanising process for treatment of metal articles.

In a hot dip galvanising process, articles are commonly treated with a flux immediately prior to the galvanising operation to prepare the surface of the article for the reaction between iron and zinc. The flux may be present in a molten state covering the surface of the galvanising bath and/or as an aqueous solution in a tank into which the article is dipped immediately to galvanising. Dry dipping is also possible.

The fluxing operation, prior to galvanising, may for example be performed in general jobbing plants, in spin galvanising plants, tube galvanising plants, and continuous strip galvanising plants.

Typical fluxes include mixtures of the chloride salts of ammonia, zinc, potassium and sodium. If no ammonium chloride is present, articles to be galvanised require a high degree of cleanliness. In fact the degree of cleanliness required is usually only attained in laboratories and pilot plants.

It is an object of the invention to provide a galvanising flux which will at least provide the public with a useful choice.

Accordingly in one aspect the invention consists in a chloride based galvanising flux containing at least zinc chloride, ammonium chloride and a rare earth chloride, said rare earth chloride comprising between substantially 500 parts per million and substantially 10% by weight of said flux.

In a further aspect the invention consists in a method of preparing a galvanising flux comprising adding an activator containing a rare earth chloride to a chloride based galvanising flux containing at least zinc chloride and ammonium chloride so that said flux contains between substantially 500 parts per million and substantially 10% by weight of rare earth chloride.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The invention consists in the foregoing and also envisages constructions of which the following gives examples.

The invention will now be illustrated by reference to the following examples.

The invention provides a galvanising flux including a rare earth chloride, and/or a method of preparing such a galvanising flux, particularly for use in the galvanising treatment of metal articles.

A galvanising flux provided in accordance with the invention comprises a chloride based galvanising flux containing at least zinc chloride and ammonium chloride. Typical fluxes of this type may contain by weight between approximately 50% of each of zinc chloride and ammonium chloride or the ratio may be varied to over a range by decreasing the ammonium chloride to say 15% by weight. The flux also contains rare earth chlorides and may suitably contain chlorides of rare earths in amounts of from about 50 ppm (0.005%) to 10,000 ppm (1%) of rare earth ions by weight when in an aqueous flux solution. Most suitably the concentration of rare earth ions in the galvanising flux solution according to the invention should lie between about 300(0.03%) to 3,000(0.3%) ppm by weight in an aqueous flux solution. Where the flux is not used in an aqueous solution the concentration of rare earth chlorides will be greater, for example ten times, those given for an aqueous flux.

The rare earth chloride could be added for example by mixing the solid rare earth chlorides into solid flux or by adding the rare earth chlorides into an aqueous flux solution in which the rare earth chlorides will readily dissolve. As the solution dilutes in use more rare earth chlorides can be added.

Cerium chloride and lanthanum chloride may usefully comprise the rare earth chlorides used and the ratio of one to the other has not been found to be of particular importance. Alternatively rare earth chlorides may be provided in approximate proportion to the ratio of rare earth elements in mischmetal which provides cerium chloride and lanthanum chloride as well as rare earth chlorides other than cerium chloride and lanthanum chloride.

EXAMPLE 1

A general jobbing galvanising plant was operated with a zinc ammonium chloride (triple salt) flux solution maintained at a concentration of approximately 25% by weight of triple salt. The amount of jobbing work requiring refluxing and redipping because of defects in the galvanised coating after the first fluxing and dipping operations was monitored.

In a trial, the triple salt flux concentration was decereased to approximately 15% by weight and an activator consisting of a mixture of rare earth chlorides with the proportion of rare earth elements approximating that of mischmetal was added to the flux solution. The concentration of rare earth ions was maintained at approximately 0.1% by weight of the flux solution by addition of one part by weight of activator per 75 parts by weight of triple salt added. Satisfactory galvanising results were obtained and the amount of work requiring refluxing and redipping decreased by approximately 60%.

EXAMPLE 2

A spin galvanising plant was operated with a flux solution containing a salt mixture comprising potassium chloride, zinc chloride and ammonium chloride in the weight ratio 1:2:2. Defects in the galvanised coatings attributable to poor fluxing were observed whenever the concentration of the salt in the flux slution decreased to less than approximately 15% by weight.

In a trial, an activator of the same composition as in Example 1 was added to the flux solution with rare earth ions at approximately 0.2% by weight of the solution. This concentration of rare earth ions was maintained by the addition of one part by weight of activator per 60 parts by weight of salt mixture added. Satisfactory galvanising results were again obtained and no defects in the galvanised coatings attributable to poor fluxing were observed until the concentration of the salt mixture in the flux solution was reduced to approximately 8% by weight.

Thus it can be seen that a galvanising flux, or a method of preparing a galvanising flux, or both are provided which can give an overall improvement in fluxing performance. As is apparent from Examples 1 and 2 the concentration of flux salts in an aqueous solution can be decreased by use of the invention by 30–50%, which can lead to decreased cost, decreased quantity of ash on the galvanising bath, and a decrease in the amount of fume produced when the flux articles are immersed in the galvanising bath, when compared with the use of commonly known fluxes. Thus a reduction in fuming is achieved even though ammonium chloride is contained in the flux.

As is apparent from Example 1, the flux including rare earth chlorides according to the invention in molten or aqueous form can be more tolerant of poor cleaning prior to fluxing, leading to the substantial reduction of rejected work associated with coating defects such as skips, black spotting and flux residues.

Articles fluxed in an aqueous solution according to the invention can show a reduced tendency to oxidation by the atmosphere in the process stage between fluxing and galvanising.

It has been found that in the double-dipping practice used for articles which are longer in dimension than the galvanising bath, the use of the invention leads to a substantial reduction of the marks on the coating where the dips overlap. In spin galvanising, articles fluxed in an aqueous solution according to the invention can show greater tolerance of high temperatures of recycled unquenched spinning baskets.

An aqueous flux according to the invention can produce a more uniform fine grained crystal structure on the fluxed ferrous surface, which is particularly advantageous in continuous strip galvanising for reducing and/or eliminating coating defects such as pin holes. In this operation it is believed that the decrease in retention time in the aqueous flux may allow cost reduction by permitting an increase in strip speed through the continuous line.

It is a further advantage of this invention that the ions introduced by the activator do not increase the toxicity of the flux or the ash and do not fume off the bath.

It has also been observed that the ash produced from the flux according to the invention when heaped in a blanket on the galvanising bath in a thickness greater than approximately 25 mm can enhance the separation of the zinc particles contained in the ash prior to the skimming of the ash from the bath.

The foregoing advantages are achieved even with low concentrations of rare earth chlorides in the flux.

What is claimed is:

1. A chloride based galvanising flux containing at least zinc chloride, ammonium chloride and a rare earth chloride, said rare earth chloride comprising between substantially 500 parts per million and substantially 10% by weight of said flux.

2. A chloride based galvanising flux as claimed in claim 1 wherein said rare earth chloride comprises between substantially 1,500 parts per million and substantially 3% by weight of said flux.

3. A chloride based galvanising flux as claimed in claim 1 wherein said rare earth chloride comprises a mixture of rare earth chlorides in proportions substantially similar to the proportions of rare earth elements in mischmetal.

4. A chloride based galvanising flux as claimed in claim 1 wherein said rare earth chlorides comprise cerium chloride or lanthanum chloride or a mixture thereof.

5. A chloride based galvanising flux as claimed in claim 1 wherein said flux comprises an aqueous solution containing at least 200 parts per million by weight of total solution of said rare earth chloride.

6. A chloride based galvanising flux as claimed in claim 5 wherein said aqueous solution includes less than 2% by weight of total solution of said rare earth chloride.

7. A method of preparing a galvanising flux comprising adding an activator containing a rare earth chloride to a chloride based galvanising flux containing at least zinc chloride and ammonium chloride so that said flux contains between substantially 500 parts per million and substantially 10% by weight of rare earth chloride.

8. A method of preparing a galvaanising flux as claimed in claim 9 wherein said flux contains between substantially 1,500 and substantially 3% by weight of rare earth chloride.

9. A method of preparing a galvanising flux as claimed in claim 7 wherein said flux is an aqueous flux containing zinc and ammonium chloride said method comprising the steps of adding an activator containing a rare earth chloride to said flux so that the said aqueous flux contains at least 200 ppm by weight of total solution of said rare earth chloride and less than 2% by weight of said rare earth chloride.

* * * * *